United States Patent [19]

Akiyama et al.

[11] Patent Number: 5,070,847

[45] Date of Patent: Dec. 10, 1991

[54] METHOD OF DETECTING ABNORMALITY IN FUEL SUPPLY SYSTEMS OF INTERNAL COMBUSTION ENGINES

[75] Inventors: Eitetsu Akiyama; Toshikazu Oketani; Shigetaka Kuroda, all of Wako, Japan

[73] Assignee: Honda Giken Kogyo K. K., Tokyo, Japan

[21] Appl. No.: 649,026

[22] Filed: Feb. 1, 1991

[30] Foreign Application Priority Data

Feb. 28, 1990 [JP] Japan ..... 2-49080

[51] Int. Cl.[5] ..... F02D 41/14

[52] U.S. Cl. ..... 123/489

[58] Field of Search ..... 123/440, 489

[56] References Cited

U.S. PATENT DOCUMENTS

| | | | |
|---|---|---|---|
| 4,392,471 | 7/1983 | Miyagi et al. | 123/489 |
| 4,664,086 | 5/1987 | Takeda et al. | 123/489 |
| 4,699,111 | 10/1987 | Yasuoka | 123/489 |
| 4,715,344 | 12/1987 | Tomisawa | 123/489 |
| 4,844,038 | 7/1989 | Yamato et al. | 123/489 X |
| 4,870,938 | 10/1989 | Nakaniwa | 123/489 |
| 4,895,122 | 1/1990 | Noguchi et al. | 123/489 |
| 4,913,122 | 4/1990 | Uchida et al. | 123/489 |
| 4,934,328 | 6/1990 | Ishii et al. | 123/489 |
| 4,951,632 | 8/1990 | Yakuwa et al. | 123/440 X |
| 4,984,551 | 1/1991 | Moser | 123/489 |

FOREIGN PATENT DOCUMENTS 0005129 1/1979 Japan .

*Primary Examiner*—Willis R. Wolfe

*Attorney, Agent, or Firm*—Arthur L. Lessler

[57] ABSTRACT

A method of detecting abnormality in a fuel supply system of an internal combustion engine. An amount of fuel supplied to the engine is controlled in a feedback manner based on an air-fuel ratio correction coefficient set in response to an output signal from at least one exhaust gas component concentration sensor. The method comprises the steps of (1) calculating an abnormality determination value based on the air-fuel ratio correction coefficient, (2) calculating a learned average value of the air-fuel ratio correction coefficient, (3) renewing the abnormality determination value when the calculated learned average value of the air-fuel ratio correction coefficient falls outside a first predetermined range defined based upon the abnormality determination coefficient, and (4) determining that the fuel supply system is abnormal when the renewed value of the abnormality determination value falls outside a second predetermined range defined by predetermined upper and lower limit values.

21 Claims, 7 Drawing Sheets

METHOD OF DETECTING ABNORMALITY IN FUEL SUPPLY SYSTEMS OF INTERNAL COMBUSTION ENGINES

BACKGROUND OF THE INVENTION

This invention relates to a method of detecting abnormality in fuel supply systems of internal combustion engines, and more particularly to a method of detecting an abnormality occurring in a fuel supply system of an internal combustion engine on the basis of a learned average value of an air-fuel ratio correction coefficient which is determined in response to an output signal from an exhaust gas component concentration sensor used for air-fuel ratio feedback control of the engine.

Conventionally, a method of detecting abnormality in a fuel supply system of an internal combustion engine is known e.g. from Japanese Provisional Patent Publication (Kokai) No. 54-5129, in which when the engine is operating in an air-fuel ratio feedback control region, the air-fuel ratio of a mixture supplied to the engine is controlled by means of an air-fuel ratio correction coefficient which is determined in response to an output signal from an exhaust gas component concentration sensor arranged in the exhaust system of the engine, and at the same time an average value of the air-fuel ratio correction coefficient is calculated, whereby it is determined that an abnormality exists in the fuel supply system when the average value exceeds a predetermined reference range.

According to the above method, the average value $K_{REF}$ is learned based on the following equation:

$$K_{REF}=K_{02}\times(C/A)+K_{REF}'\times(A-C)/A$$

where $K_{02}$ represents a value of the air-fuel ratio correction coefficient assumed upon inversion of the output level of the exhaust gas component concentration sensor or upon generation of each TDC signal pulse, $K_{REF}$, an immediately preceding value of the learned average value $K_{REF}$, A a constant, and C a variable which is set to a suitable value within a range of 1 to A.

The learned average value $K_{REF}$ is used for detecting abnormality in the fuel supply system, such as clogging of a fuel injection valve, lodging of a foreign matter in same, and aging of the system to such an extent that the fuel supply amount can no longer be properly controlled thereby. In order to detect such an abnormality promptly, the speed at which the air-fuel ratio correction coefficient $K_{02}$ is learned has to be increased by setting the variable C to a value nearer to the constant A to thereby cause the learned average value $K_{REF}$ to more rapidly reflect changes in the value of the air-fuel ratio correction coefficient $K_{02}$. However, if the variable C is set to a value near the constant A, the learned average value $K_{REF}$ reflect even an abnormal value of the air-fuel correction coefficient $K_{02}$ which is temporarily assumed due to noise in the output signal from the sensor or the like, which may lead to a false detection of an abnormality in the fuel supply system. On the other hand, in order to detect an abnormality due to aging of the system, the variable C has to be set to a value nearer to 1 to thereby calculate a learned average value $K_{REF}$ free from temporary changes in the air-fuel ratio correction coefficient $K_{02}$. However, in this case, the learned average value $K_{REF}$ too slowly reflects changes in the value of the air-fuel ratio correction coefficient $K_{02}$, which results in a delayed detection of an abnormality in the fuel supply system.

SUMMARY OF THE INVENTION

It is an object of the invention to provide a method of detecting abnormality in a fuel supply system of an internal combustion engine, which is capable of detecting the abnormality without delay and hence exhibits improved detection accuracy.

To attain the above object, the present invention provides a method of detecting abnormality in a fuel supply system for supplying fuel to an internal combustion engine having at least one exhaust pipe, and an exhaust gas component concentration sensor arranged in each of the at least one exhaust pipe for detecting concentration of a component of exhaust gases emitted from the engine, wherein an amount of fuel supplied to the engine is controlled in a feedback manner based on an air-fuel ratio correction coefficient set in response to an output signal from the exhaust gas component concentration sensor.

The method according to the invention is characterized by comprising the steps of:

(1) calculating an abnormality determination value based on the air-fuel ratio correction coefficient;

(2) calculating a learned average value of the air-fuel ratio correction coefficient;

(3) renewing the abnormality determination value when the calculated learned average value of the air-fuel ratio correction coefficient falls outside a first predetermined range defined based upon the abnormality determination coefficient; and (4) determining that the fuel supply system is abnormal when the renewed value of the abnormality determination value falls outside a second predetermined range defined by predetermined upper and lower limit values.

Preferably, the learned average value is calculated only when the engine is operating in a specific region in which the engine is under a stable operating condition.

More preferably, the learned average value has an initial value thereof set to the latest value of the abnormality determination value that was assumed and stored when the engine was in the specific region on last occasion.

Further preferably, the specific region is an engine operating region in which engine rotational speed, exhaust pipe absolute pressure, intake air temperature, and engine coolant temperature are within respective predetermined ranges.

Also preferably, the learned average value is calculated after a predetermined time period has elapsed after the engine entered the specific region.

Preferably, when the learned average value is higher than an upper limit value of the first predetermined range, the abnormality determination value is renewed to an increased value.

Also preferably, when the learned average value is lower than a lower limit value of the first predetermined range, the abnormality determination value is renewed to a decreased value.

Further preferably, after the renewal of the abnormality determination value, the renewal of the abnormality determination value is inhibited until the engine again enters the specific region.

Preferably, the renewal of the abnormality determination value is inhibited when the renewal of the abnormality determination value is not effected for a predetermined time period after the engine entered the specific region.

Also preferably, it is determined that the fuel supply system is abnormal when a predetermined time period has elapsed after the renewed value of the abnormality determination value exceeded the second predetermined range.

The above and other objects, features, and advantages of the invention will be more apparent from the ensuing detailed description taken in conjunction with the accompanying drawings.

DETAILED DESCRIPTION

The method according to the invention will now be described in detail with reference to the drawings showing an embodiment thereof.

Figure 1:
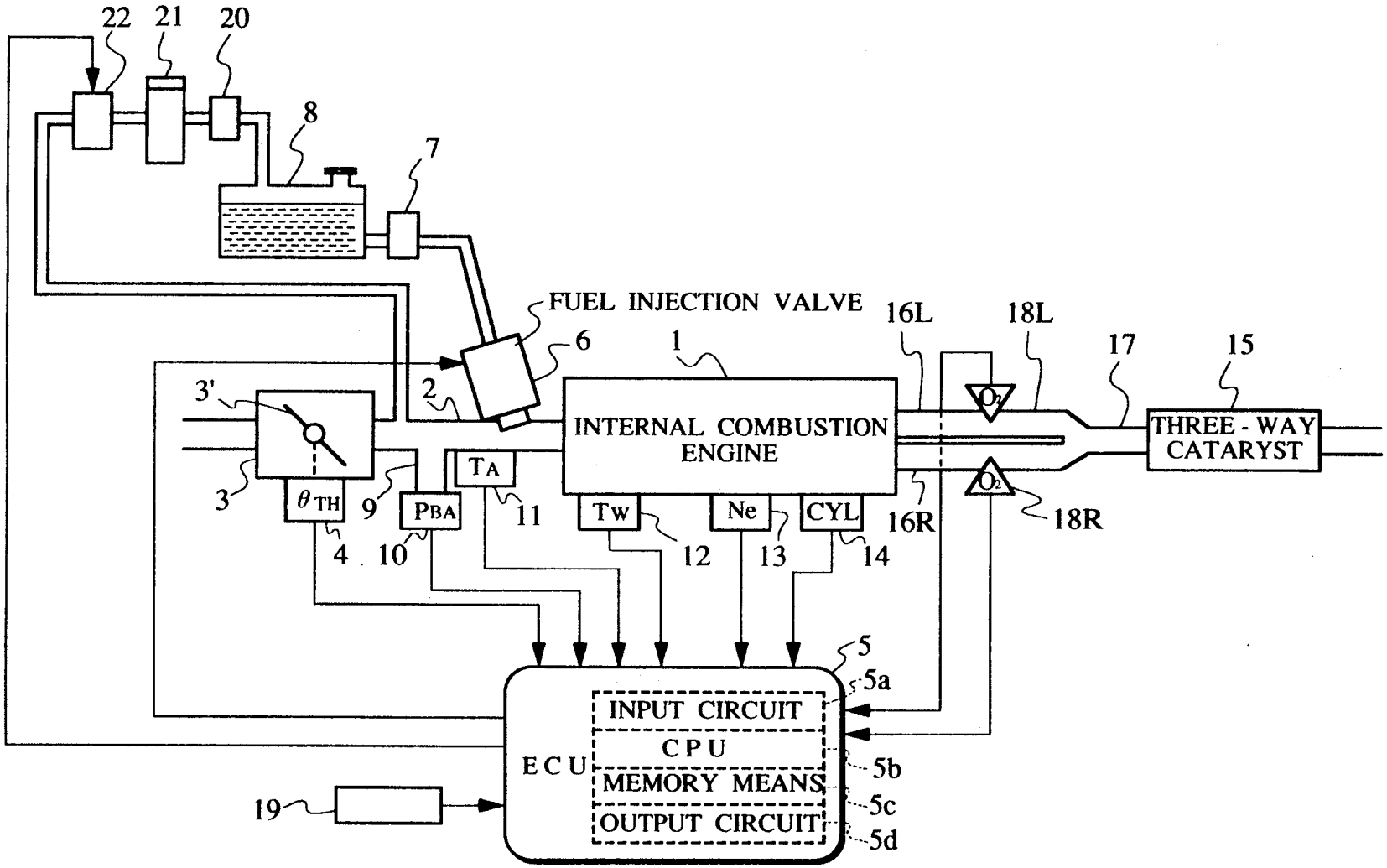
FIG. 1 is a schematic diagram showing the whole arrangement of a fuel supply control system for an internal combustion engine to which is applied the method according to the present invention.

Referring first to FIG. 1, there is shown the whole arrangement of a fuel supply control system for an internal combustion engine 1 including exhaust gas concentration sensors ($O_2$ sensors), to which is applied the method according to the invention. Reference numeral 1 designates a 4-cycle internal combustion engine having six cylinders arranged in right and left banks each comprising three cylinders. Connected to the cylinder block of the engine 1 is an intake pipe 2 across which is arranged a throttle body 3 accommodating a throttle valve 3' therein. A throttle valve opening ($\theta_{TH}$) sensor 4 is connected to the throttle valve 3' for generating an electric signal indicative of the sensed throttle valve opening and supplying same to an electronic control unit (hereinafter referred to as "the ECU") 5.

Fuel injection valves 6, only one of which is shown, are inserted into the intake pipe at locations intermediate between the cylinder block of the engine 1 and the throttle valve 3' and slightly upstream of respective intake valves, not shown. The fuel injection valves 6 are connected to a fuel tank 8 via a fuel pump 7, and electrically connected to the ECU 5 to have their valve opening periods controlled by signals therefrom.

A fuel supply system is formed by the fuel injection valves 6, the fuel tank 8, the fuel pump 7, and the piping connecting between these component parts.

On the other hand, an intake pipe absolute pressure ($P_{BA}$) sensor 10 is provided in communication with the interior of the intake pipe 2 at a location immediately downstream of the throttle valve 3' by way of a conduit 9 for supplying an electric signal indicative of the sensed absolute pressure within the intake pipe 2 to the ECU 5. An intake air temperature ($T_A$) sensor 11 is inserted into the intake pipe 2 at a location downstream of an end of the conduit 9 opening in the intake pipe for supplying an electric signal indicative of the sensed intake air temperature $T_A$ to the ECU 5.

An engine coolant temperature ($T_W$) sensor 12, which may be formed of a thermistor or the like, is mounted in the cylinder block of the engine 1, for supplying an electric signal indicative of the sensed engine coolant temperature $T_W$ to the ECU 5. An engine rotational speed (Ne) sensor 13 and a cylinder-discriminating (CYL) sensor 14 are arranged in facing relation to a camshaft, not shown, or a crankshaft, not shown, of the engine 1. The engine rotational speed sensor 13 generates a pulse as a TDC signal pulse at each of predetermined crank angles whenever the crankshaft rotates through 180 degrees, and the cylinder-discriminating sensor 14 generates a signal pulse at a predetermined crank angle position of a particular cylinder, the two kinds of pulses being supplied to the ECU 5.

A three-way catalyst 15 is arranged within a combined exhaust pipe portion 17 connected to right and left separate exhaust pipe portions $16_R$, $16_L$ respectively connected to right and left banks of the cylinders of the engine 1, for purifying noxious components such as HC, CO, and NOx. $O_2$ sensors $18_R$, $18_L$ as exhaust gas component concentration sensors are mounted in the right and left exhaust pipe portions $16_R$, $16_L$, for sensing the concentration of oxygen present in exhaust gases within the respective right and left exhaust pipe portions $16_R$, $16_L$ emitted from the right and left banks of the cylinders of the engine 1 and supplying electric signals indicative of the sensed oxygen concentration to the ECU 5. Further connected to the ECU 5 is an LED (light emitting diode) 19 for raising an alarm when an abnormality in the fuel supply system is detected by the method, as described in detail hereinafter with reference to FIG. 2.

Arranged between an upper portion of the air tight fuel tank 8 and a portion of the intake pipe 2 immediately downstream of the throttle valve 3' are a 2-way valve 20, a canister 21, and a purge control valve 22, which constitute an arrangement for preventing vaporized fuel from being emitted. The purge control valve 22 is connected to the ECU 5, and controlled by a signal therefrom. More specifically, a gas of fuel vaporized in the fuel tank 8 forces a positive pressure valve of the 2-way valve 20 to open when the pressure of the gas reaches a predetermined value, to thereby flow into the canister to be stored therein. When the purge control valve 22 opens in response to a control signal from the ECU 5, the vaporized fuel temporarily stored in the canister is absorbed into the intake pipe 2 by negative pressure within the intake pipe 2 together with air drawn in through an air suction port arranged in the canister 21, and the resulting air-fuel mixture is supplied to the cylinders. On the other hand, when the fuel tank 8 is cooled under the influence of the outside air etc. to increase the negative pressure within the fuel tank 8, a negative pressure valve of the 2-way valve opens whereby the vaporized fuel temporarily stored in the canister 21 is drawn back into the fuel tank 8. Thus, the gas of fuel vaporized in the fuel tank 8 is prevented from being emitted into the air.

The ECU 5 comprises an input circuit 5*a* having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") 5b, memory means 5c storing various operational programs which are executed in the CPU 5b and for storing results of calculations therefrom, etc., and an output circuit 5d which supplies driving signals to the fuel injection valves 6, the purge control valve 22, and the LED 19.

The CPU 5b operates in response to the above-mentioned signals from the sensors to determine operating conditions in which the engine 1 is operating, such as a feedback control region for controlling the air-fuel ratio in response to oxygen concentration in exhaust gases and a plurality of open-loop control regions in which the air-fuel ratio feedback control is not carried out, and calculates, based upon the determined operating conditions, the valve opening period or fuel injection period $T_{OUT}$ over which the fuel injection valves 6 are to be opened, by the use of the following equation (1) in synchronism with inputting of TDC signal pulses to the ECU 5:

$$T_{OUT} = Ti \times K_1 \times K_{02} + K_2 \quad (1)$$

where Ti represents a basic fuel amount, more specifically a basic value of the fuel injection period $T_{OUT}$ of the fuel injection valves 6, which is read from a Ti map set in accordance with the engine rotational speed Ne and the intake pipe absolute pressure $P_{BA}$.

$K_{02}$ is an air-fuel ratio feedback correction coefficient whose value is determined, in the feedback control region, in response to oxygen concentrations in the exhaust gases detected by the $O_2$ sensors 18R, 18L, whereas, in any of the open-loop control regions, it is set to a specific value to the corresponding control region. The correction coefficient $K_{02}$ is set for each bank of the cylinders. For example, the correction coefficient $K_{02R}$ for the right bank is calculated according to known proportional control by addition of a proportional term (P-term) when the output level of the $O_2$ sensor $18_R$ for the right bank is inverted, and according to known integral control by addition of an integral term (I-term) when the output level of the $O_2$ sensor $18_R$ remains uninverted. (This calculation method is described e.g. in U.S. Pat. No. 4,699,111.) The correction coefficient $K_{02L}$ for the left bank is also calculated in the same manner as above based on the output voltage of the $O_2$ sensor $18_L$ for the left bank.

$K_1$ and $K_2$ represent other correction coefficients and correction variables, respectively, which are calculated based on various engine parameter signals to such values as to optimize operating characteristics of the engine such as fuel consumption and accelerability, depending on operating conditions of the engine.

The CPU 5b supplies the fuel injection valves 6 with driving signals for opening same by way of the output circuit 5d, based on the fuel injection period $T_{OUT}$ obtained as above.

Figure 2A:
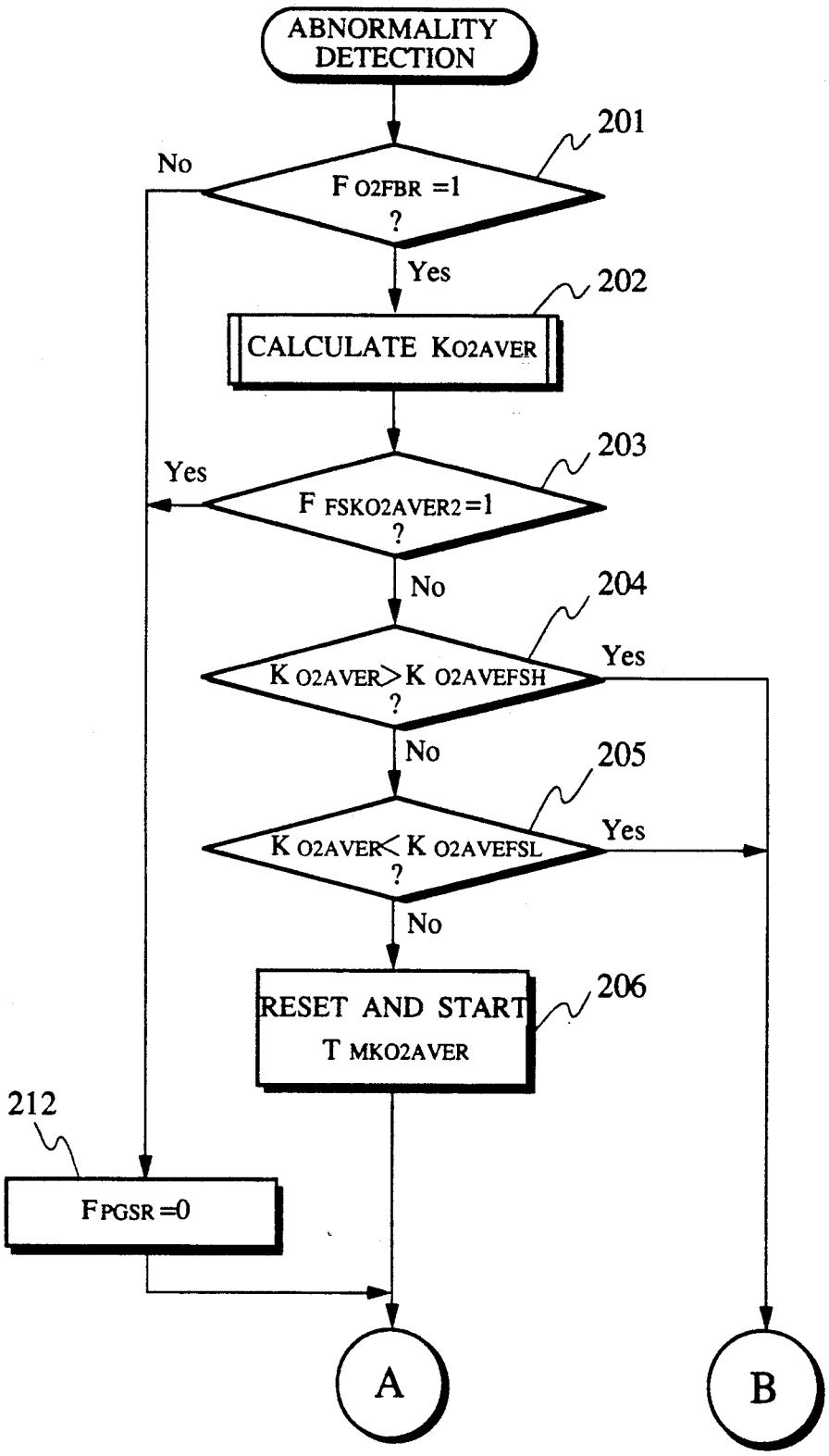
FIG. 2 is a flowchart of a program for detection of abnormality in a fuel supply system of the engine, the program being carried out by a CPU 5*b* appearing in FIG. 1.
Figure 2B:
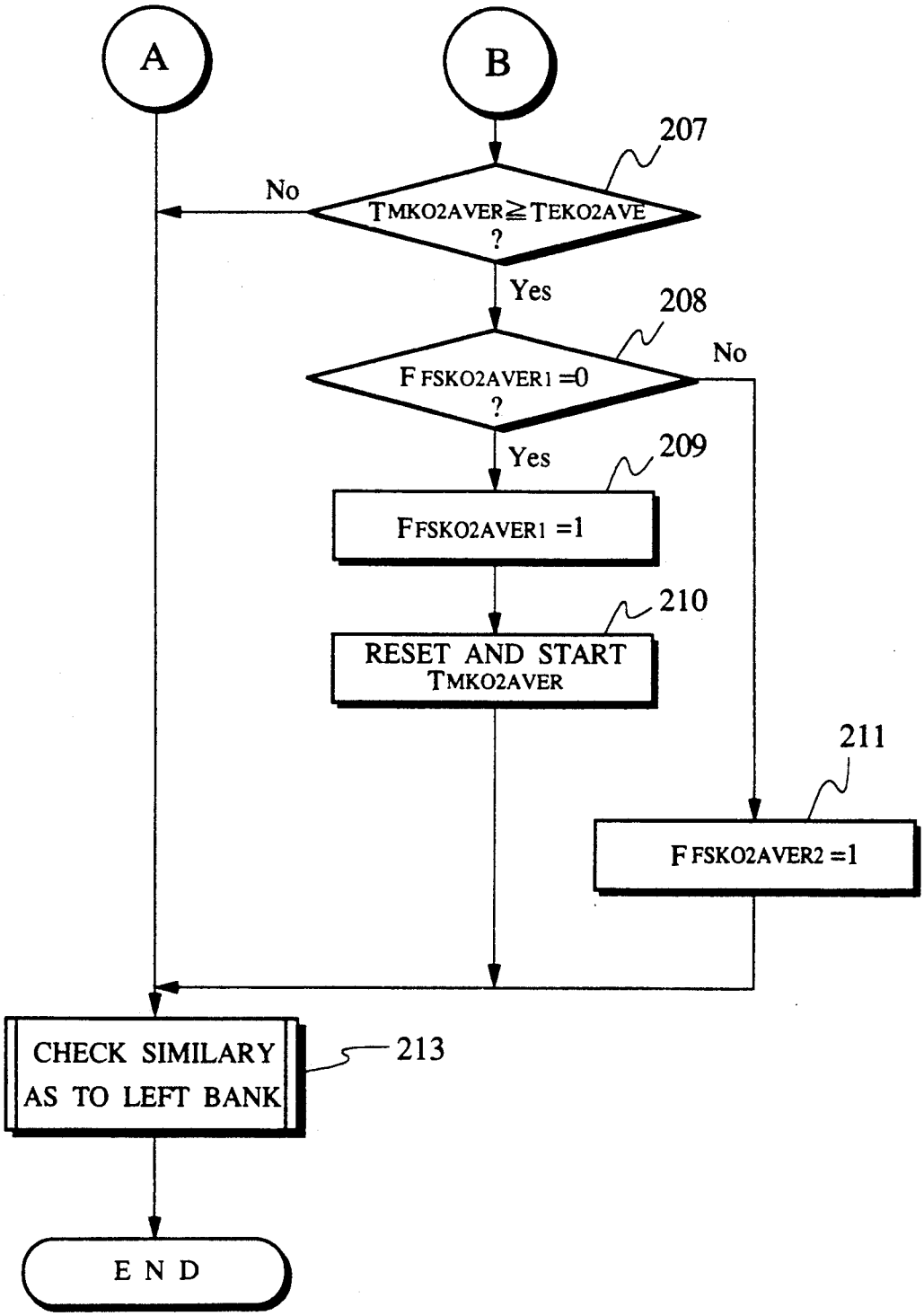

FIG. 2 shows a program for detecting abnormality in the fuel supply system, to which is applied the method according to the invention. This program is carried out by the CPU 5b by background processing.

First, processing for the right bank of cylinders is carried out. At a step 201, it is determined whether or not a flag $F_{O2FBR}$ is equal to 1. The flag $F_{O2FBR}$ is set to 1 when the engine is in a condition under which the engine should be subjected to the air-fuel ratio feedback control. An engine operating condition under which the engine should be subjected to air-fuel ratio feedback control is determined in a known manner by another control subroutine, and setting of the flag $F_{O2FBR}$ is carried out based on the result of the determination.

If the answer to the question of the step 201 is affirmative (Yes), i.e. if the engine is in a condition under which the engine should be subjected to the air-fuel ratio feedback control, an abnormality determination value $K_{O2AVER}$ is calculated at a step 202 in a manner described in detail hereinafter with reference to FIG. 3.

Then, at a step 203, it is determined whether or not a flag $F_{FSKO2AVER2}$, which is set at a step 211, referred to hereinafter, for showing a second "limit-out", is equal to 1 (the term "limit-out" used in this specification means that the abnormality determination value $K_{O2AVER}$ is larger than a predetermined upper limit value $K_{O2AVEFSH}$ or smaller than a predetermined lower limit value $K_{O2AVEFSL}$ as hereinafter referred to). This flag is initialized to 0 when the ECU 5 is turned on. If the answer to the question of the step 203 is negative (No), i.e. if the flag $F_{FSKO2AVER2}$ is equal to 0, it is determined at a step 204 whether or not the abnormality determination value $K_{O2AVER}$ calculated at the step 202 is larger than the predetermined upper limit value $K_{O2AVEFSH}$, and at a step 205 whether or not it is smaller than the predetermined lower limit value $K_{O2AVEFSL}$.

If both of the answers to the questions of the steps 204 and 205 are negative (No), i.e. if the abnormality determination value $K_{O2AVER}$ falls between the predetermined lower limit value $K_{O2AVEFSL}$ and the predetermined upper limit value $K_{O2AVEFSH}$, it is judged that the fuel supply system is normal, and a timer $T_{MKO2AVER}$ comprised of an up-counter is reset to 0 at a step 206, and started, followed by the program proceeding to a step 213, referred to hereinafter.

If either of the answers to the questions of the steps 204 and 205 is affirmative (Yes) (i.e. in the case of "limit-out"), it is determined at a step 207 whether not the count value of the timer $T_{MKO2AVER}$, which is reset and started at the step 206 or at a step 210, referred to hereinafter, is equal to or larger than a predetermined value $T_{EKO2AVE}$ (e.g. 2.5 seconds). If the answer to this question is negative (No), i.e. if the count value has not reached the predetermined value $T_{EKO2AVE}$, the program proceeds to the step 213, referred to hereinafter, whereas if the answer is affirmative (Yes), the program proceeds to a step 208.

At the step 208, it is determined whether or not a flag $F_{FSKO2AVER1}$, which is set at the following step 209 for showing a first "limit-out", is equal to 0. This flag is initialized to 0 when the ECU 5 is turned on. If the answer to this question is affirmative (Yes), the flag $F_{FSKO2AVER1}$ is set to 1 at the step 209, and then at a step 210 the timer $T_{MKO2AVER}$ is reset to 0 and started, followed by the program proceeding to the step 213. On the other hand, if the answer to the question of the step 208 is negative (No), i.e. if a predetermined time period equivalent to the predetermined value $T_{EKO2AVE}$ has elapsed after either of the answers to the questions of the steps 204 and 205 became affirmative (i.e. after the start of the state "limit-out"), and then another predetermined time period equivalent to the predetermined value $T_{EKO2AVE}$ has elapsed while the state "limit-out" holds, the program proceeds to a step 211 where the flag $F_{FSKO2AVER2}$ for showing the second "limit-out" is set to 1, followed by the program proceeding to the step 213.

When the flag $F_{FSKO2AVER2}$ is set to 1 at the step 211, it is judged accordingly by another control routine that the fuel supply system is abnormal, so that the LED 19 is lighted to thereby raise an alarm to notify the driver of the abnormality in the fuel supply system. This alarming operation is not limited to lighting of the LED 19, but an alarming sound may be produced instead. Further, a failsafe operation may be carried out e.g. by correcting the amount of fuel supply in response to the flag.

If the answer to the question of the step 201 is negative (No), i.e. if the engine is not in a condition under which the engine should be subjected to the feedback control, the program proceeds to a step 212 since the calculation of the air-fuel ratio correction coefficient $K_{O2}$ based on the output from the $O_2$ sensor $18_R$ is not carried out. At the step 212, a purge-cut flag $F_{PGSR}$ is set to 0 for carrying out purging, and then the program proceeds to the step 213. If the purge-cut flag $F_{PGSR}$ is set to 0, the purge control valve 22 is caused to open by another control routine, whereby vaporized fuel is supplied from the canister 21 to the intake pipe 2.

If the answer to the question of the step 203 is affirmative (Yes), i.e. if the flag $F_{FSKO2AVER2}$ has been set to 1 at the step 211 and hence it is indged that the fuel supply system is abnormal, as well, the program proceeds to the step 212 to set the purge-cut flag $F_{PGSR}$ to 0.

After the steps 201 to 212 related to the right bank of the cylinders are carried out, the program proceeds to the step 213, where the steps related to the left bank of the cylinders, which are similar to the steps 201 to 212, are carried out. More specifically, there are carried out steps similar to the steps 201 to 212 in which $F_{O2FBR}$ is replaced by $F_{O2FBL}$, $K_{O2AVER}$ by $K_{O2AVEL}$, $T_{MKO2AVER}$ by $T_{MKO2AVEL}$, $F_{FSKO2AVER1}$ by $F_{FSKO2AVEL1}$, $F_{FSKO2AVER2}$ by $F_{FSKO2AVEL2}$, and $F_{PGSR}$ by $F_{PGSL}$.

Figure 3A:
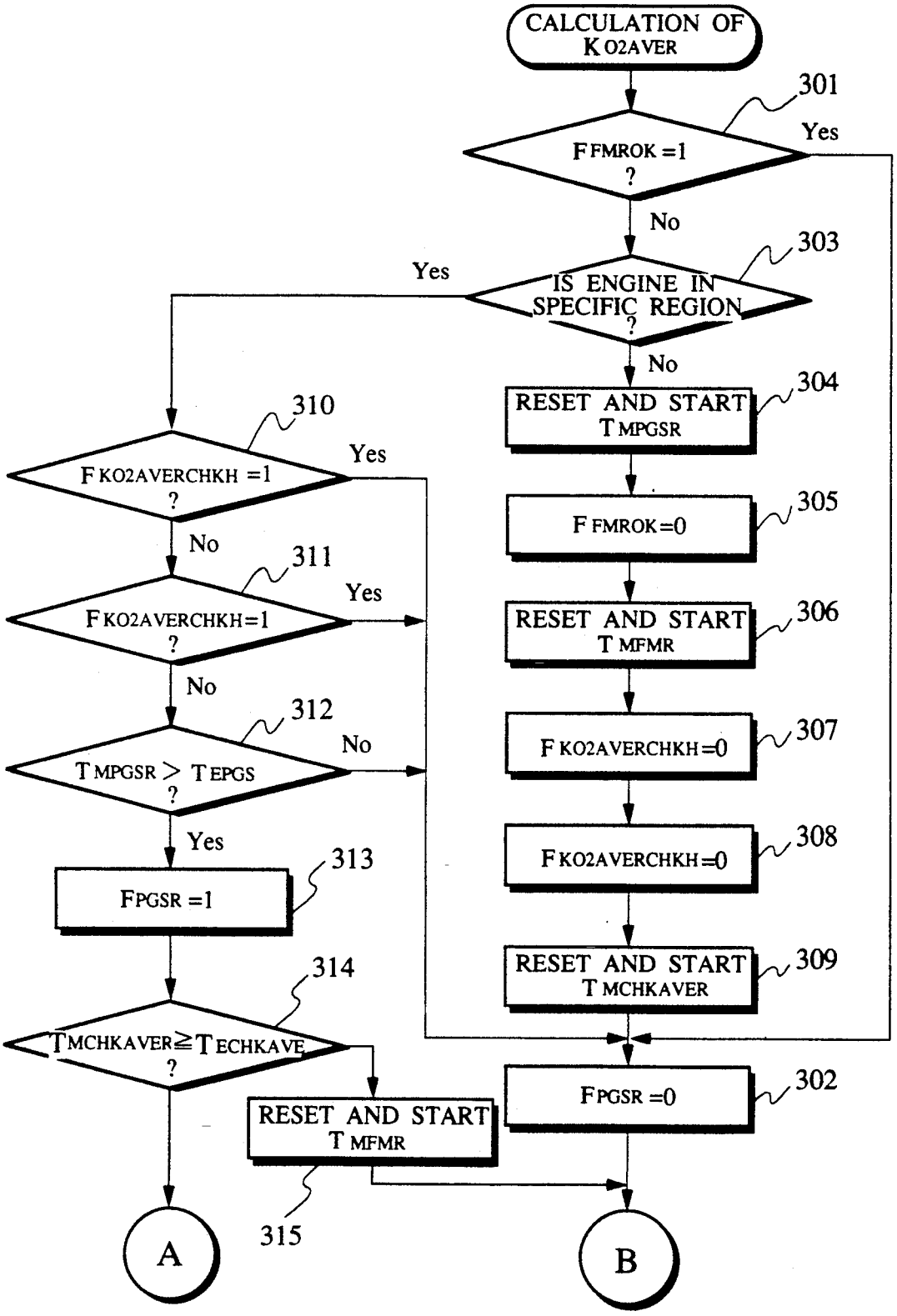
FIG. 3 is a flowchart of details of a step 202 appearing in FIG. 2.
Figure 3B:
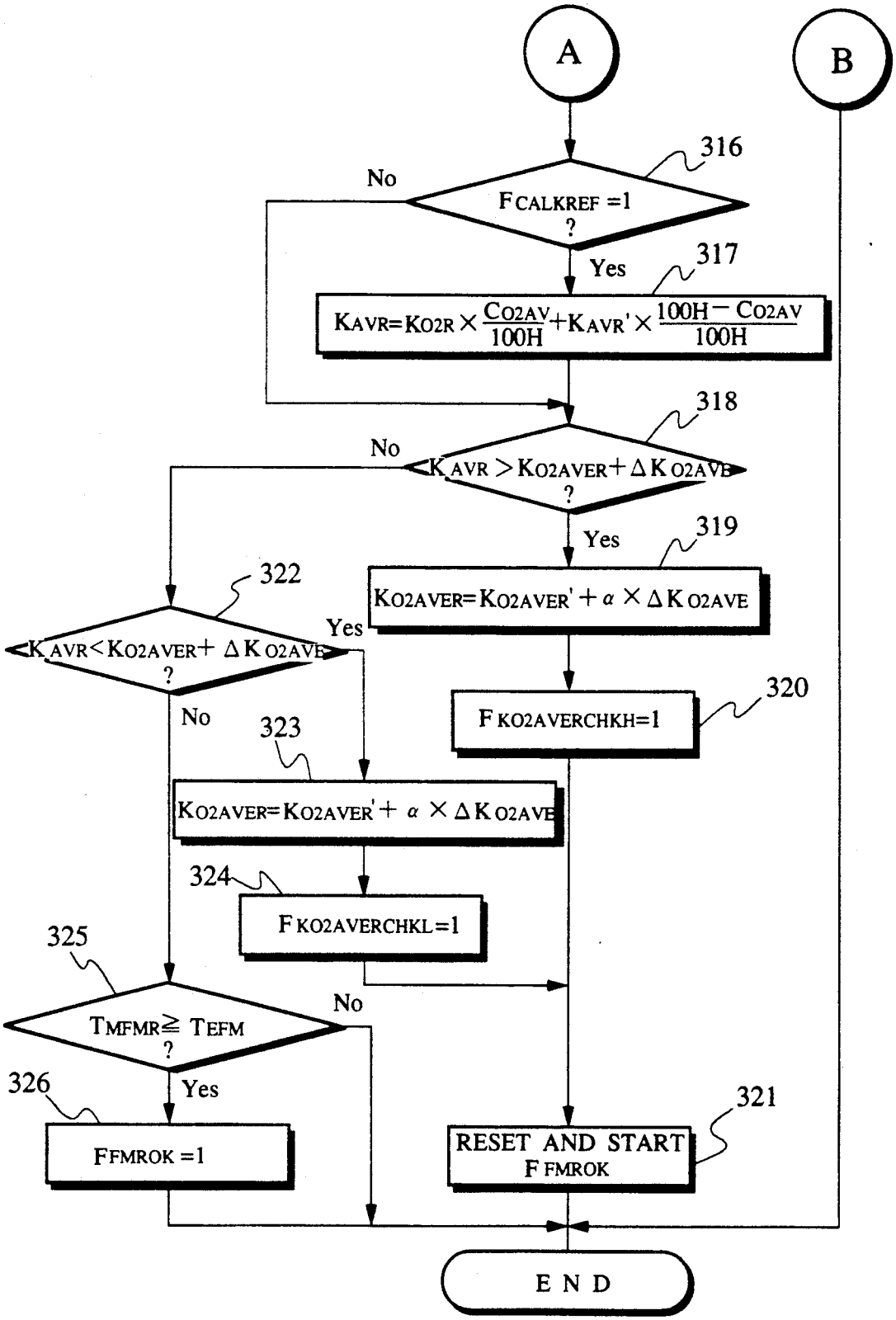

Details of the manner of calculating the abnormality determination value $K_{O2AVER}$ carried out at the step 202 are shown in FIG. 3.

First, at a step 301, it is determined whether or not a renewal-inhibiting flag $F_{FMROK}$, which is set at a step 305 or 326, referred to hereinafter, is equal to 1. This flag is set to 1 at the step 326, when the engine has continued to be operating in a specific region, which is determined at a step 303, referred to hereinafter, for a predetermined time period (e.g. 17 seconds) or longer, and at the same time the abnormality determination value $K_{O2AVER}$ has not been renewed, whereby the renewal of the coefficient $K_{O2AVER}$ is inhibited until the ECU 5 is turned off.

If the answer to the question of the step 301 is affirmative (Yes), i.e. if the flag $F_{FMROK}$ is equal to 1, the purge-cut flag $F_{PGSR}$ is set to 0 at a step 302, and the present subroutine is terminated. That is, the coefficient $K_{O2AVER}$ is not renewed, and the program proceeds to the step 203 in FIG. 2 to use an immediately preceding value (presently stored value) of the coefficient $K_{O2AVER}$ in the program of FIG. 2. On the other hand, if the answer to the question of the step 301 is negative (No), the program proceeds to the step 303.

At the step 303, it is determined whether or not the engine is operating in the specific region within the feedback control region. The specific region is a region in which the engine operating condition is stable. For example, it is determined that the engine is operating in the specific region, when the engine rotational speed Ne is between a lower limit value $N_{AVEL}$ (e.g. 1504 rpm) and an upper limit value $N_{AVEH}$ (e.g. 2496 rpm) (the lower and upper limit values may be set to different respective values between an AT vehicle and an MT vehicle), the intake pipe absolute pressure $P_{BA}$ is between a lower limit value $P_{BAVEL}$ (e.g. 263 mmHg) and an upper limit value $P_{BAVEH}$ (e.g. 435 mmHg) (the lower and upper limit values may be set to different respective values between an AT vehicle and an MT vehicle), the intake air temperature $T_A$ is between a lower limit value $T_{AAVEL}$ (e.g. 20° C.) and an upper limit value $T_{AAVEH}$ (e.g. 70° C.), and the engine coolant temperature $T_W$ is between a lower limit value $T_{WAVEL}$ (e.g. 70° C.) and an upper limit value $T_{WAVEH}$ (e.g. 90° C.).

If the answer to the question of the step 303 is negative (No), i.e. if the engine is not operating in the specific region, a purge-cut delay timer $T_{MPGSR}$ comprised of an up-counter is reset to 0 and started at a step 304, and the renewal-inhibiting flag $F_{FMROK}$ is set to 0 at a step 305. Further, at a step 306, a stabilization-judging timer $T_{MFMR}$ comprised of an up-counter is reset to 0 and started, at a step 307, a flag $F_{KO2AVERCHKH}$ for only once renewing the abnormality determination value $K_{O2AVER}$ to a larger value while the engine continues to be operating in the specific region is set to 0, at a step 308, a flag $F_{KO2AVERCHKL}$ for only once renewing the abnormality determination value $K_{O2AVER}$ to a smaller value while the engine continues to be operating in the specific region is set to 0, at a step 309, a stabilization timer $T_{MCHKAVER}$ comprised of an up-counter is reset to 0 and started, and the program proceeds to the step 302, followed by termination of the subroutine. Thus, also in this case, an immediately preceding value (presently stored value) of the abnormality determination value $K_{O2AVER}$ is used without renewing same.

If the answer to the question of the step 303 is affirmative (Yes), i.e. if the engine is operating in the specific region, it is determined at a step 310 whether or not the flag $F_{KO2AVERCHKH}$ is equal to 1, and at a step 311 whether or not the flag $F_{KO2AVERCHKL}$ equal to 1.

If either of the answers to the questions of the steps 310 and 311 is affirmative (Yes) (these flags are set to 1 at steps 320 and 324, referred to hereinafter), the program proceeds to the step 302, so that the renewal of the abnormality determination value $K_{O2AVER}$ is not carried out until the engine again enters the specific region. If both of the answers to the questions of the steps 310 and 311 are negative (No), it is determined at a step 312 whether or not the count value of the purge-cut delay timer $T_{MPGSR}$ started at the step 304 is larger than a predetermined value $T_{EPGS}$ (e.g. 2 seconds).

If the answer to the question of the step 312 is negative (No), i.e. a predetermined time period corresponding to the predetermined value $T_{EPGS}$ has not elapsed after the engine entered the specific region, the program proceeds to the step 302, whereas if the predetermined time period has elapsed to make the answer to the question of the step 312 affirmative (Yes), the purge-cut flag $F_{PGSR}$ is set to 1 for inhibiting purging of the vaporized fuel by the purge-control valve 22. More specifically, after the engine entered the specific region and before the predetermined time period corresponding to the predetermined reference value $T_{EPGS}$ elapses, the purge-control valve 22 is kept open to thereby supply the vaporized fuel to the intake pipe (i.e. carry out purging), and after the predetermined time period has elapsed, the purge-control valve 22 is closed to inhibit purging (i.e. supply of the vaporized fuel to the intake pipe). By thus inhibiting the purging, it becomes possible to accurately calculate the abnormality determination value $K_{O2AVER}$.

Then at a step 314, it is determined whether or not the count value of the stabilization timer $T_{MCHKAVER}$ reset and started at the step 309 is larger than a predetermined value $T_{ECHKAVE}$ (e.g. 4 seconds). This step is provided for inhibiting calculation of the abnormality determination value $K_{O2AVER}$ until after the operating condition of the engine is stabilized after the engine entered the specific region. If the answer to this question is negative (No), i.e. if a predetermined time period corresponding to the predetermined reference value $T_{ECHKAVE}$ has not elapsed yet, the program proceeds to a step 315, where the stabilization-judging timer $T_{MFMR}$ is reset to 0, followed by terminating the subroutine, so that as the abnormality determination value $K_{O2AVER}$, an immediately preceding value (presently stored value) thereof is used. On the other hand, if the predetermined time period has elapsed to make the answer to the question of the step 314 affirmative (Yes), the program proceeds to a step 316.

At the step 316, it is determined whether or not a flag $F_{CALKREF}$, which is set to 1 by another control routine when the output level of the $O_2$ sensor $18_R$ is inverted, is equal to 1. If the answer to this question is affirmative (Yes), i.e. when the air-fuel ratio correction coefficient $K_{O2R}$ is calculated according to known proportional control by addition of a proportional term (P-term), an integral value $K_{AVR}$, which is a learned average value of the correction coefficient $K_{O2R}$, is calculated at a step 317 based on the following equation (2):

$$K_{AVR}=K_{O2R}\times(C_{O2AV}/100H)+K_{AVR'}\times(100H-C_{O2AV})/100H \quad (2)$$

where $C_{O2AV}$ is a variable which is set to a relatively large value in order to more promptly reflect changes in the correction coefficient $K_{O2R}$ in the specific region of the engine, and $K_{AVR'}$ is an immediately preceding value of the integral value $K_{AVR}$. The initial value of $K_{AVR}$ is set to the latest value of $K_{O2AVER}$ that was assumed and stored when the engine was in the specific region on last occasion. It is set to the initial value of the abnormality determination value $K_{O2AVER}$, i.e. $K_{REF}$, as referred to hereinafter, when the engine has entered the specific region for the first time after the start of the engine.

If the answer to the question of the step 316 is negative (No), the step 317 is skipped over, to use as $K_{AVR}$ an immediately preceding value (presently stored value) thereof.

Then, at a step 318, it is determined whether or not the thus obtained integral value $K_{AVR}$ is larger than the sum of an immediately preceding value (presently stored value) of $K_{O2AVER}$ and a deviation value $\Delta K_{O2AVE}$ for judging aging (e.g. 800H). The initial value of $K_{O2AVER}$ is set to an average value $K_{REF}$ of $K_{O2R}$ which is obtained by another control routine in a known manner. If the answer to the question of the step 318 is affirmative (Yes), a renewed value of the abnormality determination value $K_{O2AVER}$ is calculated for renewal based on the following equation (3) (step 319):

$$K_{O2AVER}=K_{O2AVER'}+\alpha\times\Delta K_{O2AVE} \quad (3)$$

where $K_{O2AVER'}$ is an immediately preceding value of $K_{O2AVER}$, and $\alpha$ on the right side is a coefficient ($\leqq 1.0$) set depending on operating conditions of the engine, which is set e.g. to 0.5.

Then at a step 320, the flag $F_{KO2AVERCHKH}$ is set to 1 to thereby indicate that the abnormality determination value $K_{O2AVER}$ has been renewed to a value which is larger than an immediately preceding value by $\alpha\times\Delta K_{O2AVE}$. The stabilization-judging timer $T_{MFMR}$ is reset to 0 and started at a step 321, followed by terminating the present routine, and the program proceeds to the step 203 in FIG. 2.

If the answer to the question of the step 318 is negative (No), it is determined at a step 322 whether or not the integral value $K_{AVR}$ is smaller than a value obtained by subtracting the deviation value $\Delta K_{O2AVE}$ from an immediately preceding value (presently stored value) of $K_{O2AVER}$. If the answer to this question is affirmative (Yes), a renewed value of the abnormality determination value $K_{O2AVER}$ is calculated for renewal based on the following equation (4) (step 323):

$$K_{O2AVER}=K_{O2AVER'}-\alpha\times\Delta K_{O2AVE} \quad (4)$$

Then at a step 324, the flag $F_{KO2AVERCHKL}$ is set to 1 to thereby indicate that the coefficient $K_{O2AVER}$ has been renewed to a value which is smaller than an immediately preceding value by $\alpha\times\Delta K_{O2AVE}$, followed by the program proceeding to the step 321.

If the answer to the question of the step 322 is negative (No), it is determined at a step 325 whether or not the count value of the stabilization-judging timer $T_{MFMR}$ reset and started at the step 315 or 321 is equal to or larger than a predetermined reference value $T_{EFM}$ (e.g. 15 seconds). This step is provided for determining whether or not after the predetermined time period corresponding to the predetermined value $T_{ECHKAVE}$ at the step 314 elapsed after the engine entered the specific region, the state in which the integral value $K_{AVR}$ is within a range defined by ($K_{O2AVER}+\Delta K_{O2AVE}$) and ($K_{O2AVER}-\Delta K_{O2AVE}$) has continued over a predetermined time period corresponding to the predetermined value $T_{EFM}$. If the answer to the question of the step 325 is negative (No), i.e. if the predetermined time period corresponding to the predetermined value $T_{EFM}$ has not elapsed yet, the following step 326 is skipped over, whereas the predetermined time period has elapsed to make the answer to the question of the step 325 affirmative (Yes), the renewal-inhibiting flag $F_{FMROK}$ is set to 1 at the step 326, followed by terminating the present routine, while using as the coefficient $K_{O2AVER}$ an immediately preceding value (presently stored and non-renewed value). In this connection, by setting the renewal-inhibiting flag $F_{FMROK}$ to 1, the abnormality determination value $K_{O2AVER}$ is not renewed until the ECU is turned off, since the step 301 is carried out.

At the step 213 in FIG. 2, the calculation of the abnormality determination value $K_{O2AVEL}$ for the left bank of cylinders is carried out in a manner similar to the calculation of $K_{O2AVER}$ shown in FIG. 3. More specifically, at the step 213, $K_{O2AVER}$ is replaced by $K_{O2AVEL}$, $K_{O2R}$ by $K_{O2L}$, $K_{AVR}$ by $K_{AVL}$, $F_{PGSR}$ by $F_{PGSL}$, $F_{FMROK}$ by $F_{FMLOK}$, $F_{KO2AVERCHKH}$ by $F_{KO2AVELCHKH}$, $F_{KO2AVERCHKL}$ by $F_{KO2AVELCHKL}$, $T_{MCHKAVER}$ by $T_{MCHKAVEL}$, $T_{MFMR}$ by $T_{MFML}$, and $T_{MPGSR}$ by $T_{MPGSL}$.

Figure 4:
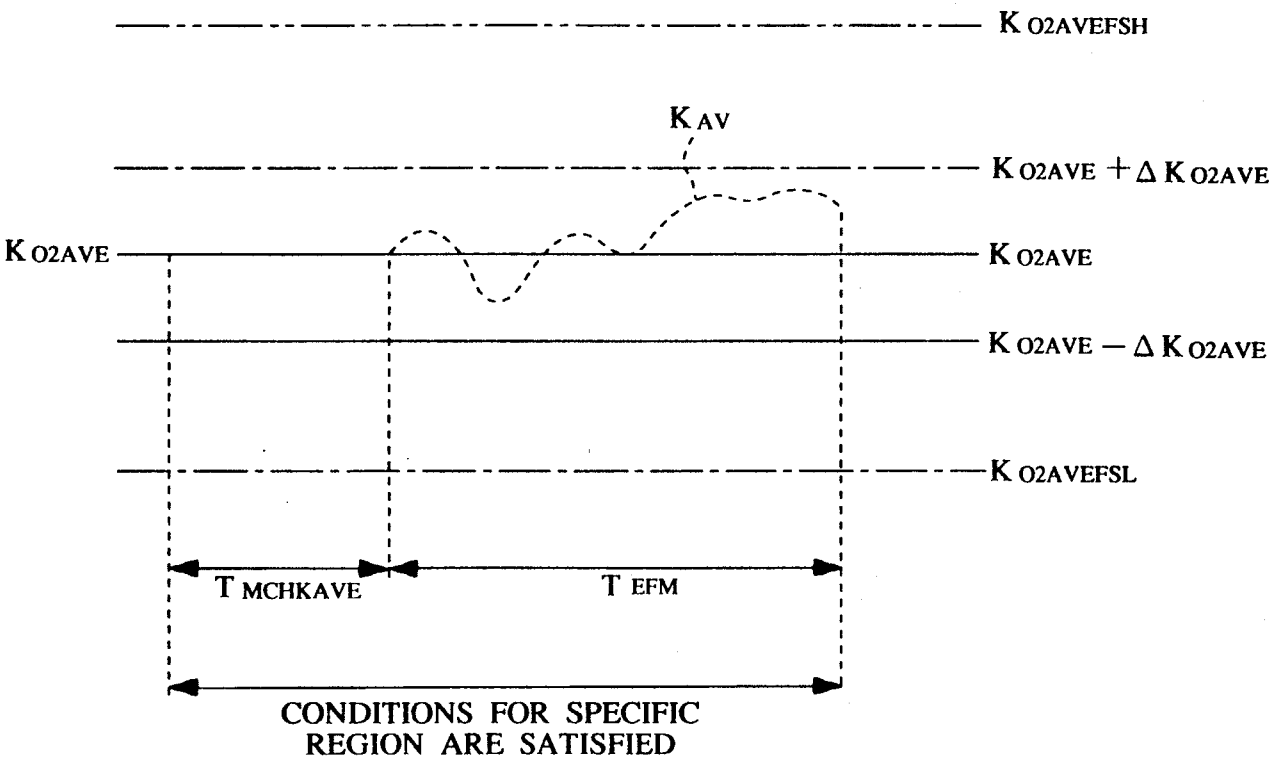
FIG. 4 is a graph showing changes in a coefficient $K_{02AVE}$ occurring in accordance with the procedures shown in FIG. 3 when the fuel supply system is normally operating.
Figure 5:
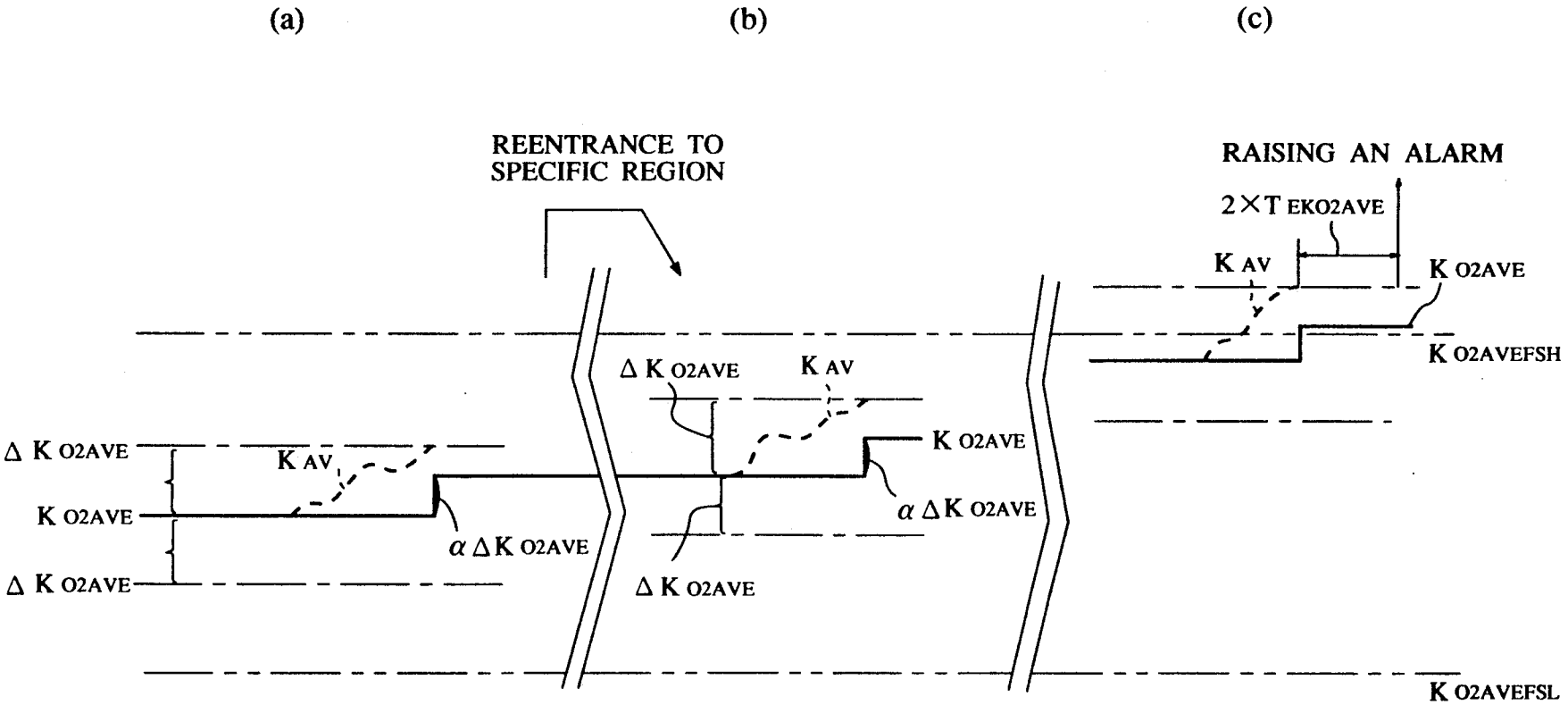
FIGS. 5*a–c*, are graphs showing changes in the coefficient $K_{02AVE}$ occuring in accordance with the procedures shown in FIGS. 2 and 3 when the fuel supply system is abnormal.

FIGS. 4 and 5 show changes in the abnormality determination value $K_{O2AVE}$ occurring in accordance with the procedures shown in FIGS. 2 and 3. FIG. 4 is a graph illustrating the case where the fuel supply system is normally operating, whereas FIG. 5 is a graph illustrating the case where the fuel supply system is abnormal. Further, in the following, description is made indifferently to the right and left banks of cylinders. That is, the subscripts $_L$ and $_R$ are omitted from the symbols.

First, referring to FIG. 4, when the predetermined time period $T_{MCHKAVE}$ elapses after the engine entered the specific region (which is determined at the step 314 in FIG. 3), the integral value $K_{AV}$ is calculated (at the step 317 in FIG. 3), and observation of whether the calculated integral value $K_{AV}$ exceeds a range defined by $(K_{O2AVE}+\Delta K_{O2AVE})$ and $(K_{O2AVE}-\Delta K_{O2AVE})$ is carried out over the predetermined time $T_{EFM}$ (at the steps 318, 322, and 325). If the integral value $K_{AV}$ does not exceed the range over the predetermined time period $T_{EFM}$, the abnormality determination value $K_{O2AVE}$ is not renewed until the ECU 5 is turned off, so that it is judged that the fuel supply system is normally operating.

On the other hand, as shown in FIG. 5 (a), if the integral value $K_{AV}$ exceeds e.g. $(K_{O2AVE}+\Delta K_{O2AVE})$ before the predetermined time period $T_{EFM}$ elapses, the coefficient $K_{O2AVE}$ is renewed to a value of $(K_{O2AVE}+\alpha\times\Delta K_{O2AVE})$ (at the step 319 in FIG. 3). And then, so long as the engine remains in the specific region, renewal of the abnormality determination value $K_{O2AVE}$ is not carried out. However, if the engine once entered another operating region, and then entered the specific region again, as shown in FIG. 5 (b), the integral value $K_{AV}$ is calculated based on the coefficient $K_{O2AVE}$ renewed in FIG. 5 (a), and compared with values $(K_{O2AVE}\pm\Delta K_{O2AVE})$ based on the renewed coefficient $K_{O2AVE}$. Then, if the integral value $K_{AV}$ exceeds a value $(K_{O2AVE}+\Delta K_{O2AVE})$ for example, the coefficient $K_{O2AVE}$ is further renewed to a value $(K_{O2AVE}+\alpha\times\Delta K_{O2AVE})$ based on the renewed value of $K_{O2AVE}$.

Thereafter, as shown in FIG. 5 (c), if, for example, the coefficient $K_{O2AVE}$ becomes larger than the predetermined upper limit value $K_{O2AVEFSH}$, and the state in which the coefficient $K_{O2AVE}$ is larger than the value $K_{O2AVEFSH}$ (i.e. the answer to the question of the step 204 in FIG. 2 is affirmative (Yes)) continues for two times as long as the predetermined time period $T_{EKO2AVE}$, it is judged that the fuel supply system is abnormal, and an alarm is raised to notify the driver of the abnormality.

What is claimed is:

1. A method of detecting abnormality in a fuel supply system for supplying fuel to an internal combustion engine having at least one exhaust pipe, and an exhaust gas component concentration sensor arranged in each of said at least one exhaust pipe for detecting concentration of a component of exhaust gases emitted from said engine, wherein an amount of fuel supplied to said engine is controlled in a feedback manner based on an air-fuel ratio correction coefficient set in response to an output signal from said exhaust gas component concentration sensor, the method comprising the steps of:

(1) calculating an abnormality determination value based on said air-fuel ratio correction coefficient;

(2) calculating a learned average value of said air-fuel ratio correction coefficient;

(3) renewing said abnormality determination value when said calculated learned average value of said air-fuel ratio correction coefficient falls outside a first predetermined range defined based upon said abnormality determination coefficient; and (4) determining that said fuel supply system is abnormal when the renewed value of said abnormality determination value falls outside a second predetermined range defined by predetermined upper and lower limit values.

2. A method according to claim 1, wherein said learned average value is calculated only when the engine is operating in a specific region in which said engine is under a stable operating condition.

3. A method according to claim 2, wherein said learned average value has an initial value thereof set to the latest value of said abnormality determination value that was assumed and stored when said engine was in said specific region on last occasion.

4. A method according to claim 3, wherein said specific region is an engine operating region in which engine rotational speed, exhaust pipe absolute pressure, intake air temperature, and engine coolant temperature are within respective predetermined ranges.

5. A method according to claim 3 or 4, wherein said learned average value is calculated after a predetermined time period has elapsed after said engine entered said specific region.

6. A method according to claim 1, wherein when said learned average value is higher than an upper limit value of said first predetermined range, said abnormality determination value is renewed to an increased value.

7. A method according to claim 1 or 6, wherein when said learned average value is lower than a lower limit value of said first predetermined range, said abnormality determination value is renewed to a decreased value.

8. A method according to claim 7, wherein it is determined that said fuel supply system is abnormal when a predetermined time period has elapsed after the renewed value of said abnormality determination value exceeded said second predetermined range.

9. A method according to claim 7, wherein said renewal of said abnormality determination value is inhibited when said renewal of said abnormality determination value is not effected for a predetermined time period after said engine entered said specific region.

10. A method according to claim 9, wherein it is determined that said fuel supply system is abnormal when a predetermined time period has elapsed after the renewed value of said abnormality determination value exceeded said second predetermined range.

11. A method according to claim 7, wherein after said renewal of said abnormality determination value, said renewal of said abnormality determination value is inhibited until said engine again enters said specific region.

12. A method according to claim 11, wherein it is determined that said fuel supply system is abnormal when a predetermined time period has elapsed after the renewed value of said abnormality determination value exceeded said second predetermined range.

13. A method according to claim 11, wherein said renewal of said abnormality determination value is inhibited when said renewal of said abnormality determination value is not effected for a predetermined time period after said engine entered said specific region.

14. A method according to claim 13, wherein it is determined that said fuel supply system is abnormal when a predetermined time period has elapsed after the renewed value of said abnormality determination value exceeded said second predetermined range.

15. A method according to claim 1, 3, 4, or 6, wherein it is determined that said fuel supply system is abnormal when a predetermined time period has elapsed after the renewed value of said abnormality determination value exceeded said second predetermined range.

16. A method according to claim 3, 4, or 6, wherein said renewal of said abnormality determination value is inhibited when said renewal of said abnormality determination value is not effected for a predetermined time period after said engine entered said specific region.

17. A method according to claim 3, 4, or 6, wherein after said renewal of said abnormality determination value, said renewal of said abnormality determination value is inhibited until said engine again enters said specific region.

18. A method according to claim 17, wherein it is determined that said fuel supply system is abnormal when a predetermined time period has elapsed after the renewed value of said abnormality determination value exceeded said second predetermined range.

19. A method according to claim 17, wherein said renewal of said abnormality determination value is inhibited when said renewal of said abnormality determination value is not effected for a predetermined time period after said engine entered said specific region.

20. A method according to claim 19, wherein it is determined that said fuel supply system is abnormal when a predetermined time period has elapsed after the renewed value of said abnormality determination value exceeded said second predetermined range.

21. A method according to claim 16, wherein it is determined that said fuel supply system is abnormal when a predetermined time period has elapsed after the renewed value of said abnormality determination value exceeded said second predetermined range.

* * * * *